US009611434B2

(12) United States Patent
Morgan et al.

(10) Patent No.: US 9,611,434 B2
(45) Date of Patent: Apr. 4, 2017

(54) METAL REMOVAL FROM LIQUID HYDROCARBON STREAMS

(71) Applicant: BAKER HUGHES INCORPORATED, Houston, TX (US)

(72) Inventors: Waynn C. Morgan, Alvin, TX (US); Tran Nguyen, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 14/889,478

(22) PCT Filed: May 7, 2014

(86) PCT No.: PCT/US2014/037095

§ 371 (c)(1),
(2) Date: Nov. 6, 2015

(87) PCT Pub. No.: WO2014/182779

PCT Pub. Date: Nov. 13, 2014

(65) Prior Publication Data

US 2016/0122659 A1 May 5, 2016

Related U.S. Application Data

(60) Provisional application No. 61/821,524, filed on May 9, 2013.

(51) Int. Cl.

| | |
|---|---|
| ***C10G 31/08*** | (2006.01) |
| ***C10G 31/09*** | (2006.01) |
| ***C10G 33/04*** | (2006.01) |
| ***C10G 53/02*** | (2006.01) |

(52) U.S. Cl.

CPC ..... *C10G 31/08* (2013.01); *C10G 31/09* (2013.01); *C10G 33/04* (2013.01); *C10G 53/02* (2013.01)

(58) Field of Classification Search

CPC ..... C10G 33/00; C10G 33/02; C10G 33/04; C10G 33/06; C10G 31/08; C10G 31/09; C10G 17/00; C10G 17/02; C10G 17/04

See application file for complete search history.

(56) References Cited

U.S. PATENT DOCUMENTS

| | | | | |
|---|---|---|---|---|
| 4,556,480 | A * | 12/1985 | Cawi | C10G 33/06 208/211 |
| 5,080,779 | A * | 1/1992 | Awbrey | C10G 17/02 208/251 R |
| 5,543,041 | A | 8/1996 | Okazaki et al. | |
| 2007/0175799 | A1 | 8/2007 | Tomlinson et al. | |
| 2010/0000910 | A1 | 1/2010 | Gallup et al. | |
| 2011/0172473 | A1* | 7/2011 | Nguyen | B01D 17/0217 585/3 |
| 2012/0067784 | A1 | 3/2012 | Gallup et al. | |
| 2012/0181218 | A1 | 7/2012 | Chakka et al. | |
| 2012/0187049 | A1 | 7/2012 | Nguyen et al. | |
| 2013/0334137 | A1* | 12/2013 | Seibert | B01D 61/58 210/636 |

* cited by examiner

*Primary Examiner* — Randy Boyer
*Assistant Examiner* — Juan Valencia
(74) *Attorney, Agent, or Firm* — Mossman Kumar & Tyler PC

(57) ABSTRACT

Multi-valent metals, such as mercury, may be removed from a liquid hydrocarbon stream, such as crude oil, by optionally blending the liquid hydrocarbon stream with water or alternatively utilizing the water existing in the hydrocarbon as received, to give a homogeneous blend, and adding at least one demulsifier to the liquid hydrocarbon, water and/or homogeneous blend. Water is then extracted leaving a treated liquid hydrocarbon, and the treated liquid hydrocarbon is passed through at least one particle filter and optionally a series of filters of sequentially decreasing pore size. The resulting at least partially demetallized liquid hydrocarbon (e.g. crude oil) having reduced metal content will cause fewer problems for production, transportation, downstream refinery operations, and the environment.

20 Claims, No Drawings

METAL REMOVAL FROM LIQUID HYDROCARBON STREAMS

TECHNICAL FIELD

The present invention relates to methods and compositions for removing metals from liquid hydrocarbons, and more particularly relates, in one non-limiting embodiment, to methods and compositions for removing metals such as mercury from crude oil by optionally washing with water as necessary, using at least one demulsifier and a filtration process that is comprised of one or more filtration vessels and filtration media.

BACKGROUND

In an oil refinery, the removing of metals, such as mercury and iron, from crude oil has been practiced for many years. The crude may be contaminated with these metals from several sources, including, but not necessarily limited to:

- Brine contamination in the crude oil as a result of the brine associated with the oil in the ground;
- Minerals, clay, silt, and sand from the formation around the oil well bore;
- Metals in the formation including, but not necessarily limited to, mercury, iron, calcium, zinc, silicon, nickel, sodium, potassium, etc.; and
- Iron sulfides and iron oxides resulting from pipeline and vessel corrosion during production, transport, and storage.

As noted, liquid hydrocarbon streams may be contaminated with mercury. Mercury imposes health and environmental hazards which must be dealt with in these contaminated streams. The mercury content also decreases the value of the hydrocarbon stream. Prior methods of removing mercury have utilized filtration and other means of mercury removal. However, usually the filtration process rate is hindered due to interference from water, solids and oil emulsions and/or interfaces which impede the process.

Further, much of the solids encountered during crude oil production consists of iron, most commonly as particulate iron such as iron oxide, iron (II) sulfide (FeS; ferrous sulfide), etc. As noted, other metals that are present and which may be desirably removed include, but are not necessarily limited to, mercury, copper, aluminum, calcium, zinc, silicon, nickel, sodium, potassium, and the like, and typically a number of these metals are present. Some of the metals may be present in a soluble form. The metals may be present in inorganic or organic forms. The presence of these metals can reduce the value of the crude and reduce the markets into which the hydrocarbon may be sold. Furthermore, the metals can introduce or affect a corrosion rate to other metals (such as aluminum) that is unacceptable. Finally, the disposal of mercury in oil production can become an environmental challenge, and create further restrictions on production rates.

In addition to complicating the crude oil management through the refining and more specifically the desalter operation, mercury, iron and other metals are of particular concern to further downstream processing. This includes the coking operation since iron and other metals remaining in the processed hydrocarbon yields a lower grade of coke. Removing the metals from the crude oil early in the hydrocarbon processing stages is desired to eventually yield high quality coke as well as to limit corrosion and fouling processing problems. Furthermore, some mercury contamination may be seen in other distillation fractions which can result in downstream corrosion and fouling issues in the downstream operations.

Several treatment approaches have been made to reduce total metal levels and these traditionally all center on the removal of metals at the desalter unit. Normally, the desalter only removes water soluble inorganic salts such as sodium or potassium chlorides. Some crude oils contain water insoluble metal organic acid salts such as calcium naphthenate and iron naphthenate, which are soluble or dispersed as fine particulate matter in the oil but not in water.

The metals present in crude oil are often in the form of metal salts and removing them is often performed in a desalter. Desalting involves the resolution of a natural emulsion of water that may accompany the crude oil by creating another emulsion in which about 2 to about 5 volume percent relative wash water is dispersed into the oil, typically using a mix valve. Alternatively, the crude oil may not comprise such a "natural emulsion". The streams of desalted crude oil and effluent water are separately discharged from the desalter. The entire desalting process is a continuous flow procedure as opposed to a batch process. Normally, chemical additives, such as demulsifiers, are injected before the mix valve to help resolve the oil/water emulsion in addition to the use of electrostatic coalescence.

However, it would be desirable if metals such as mercury, among others, could be at least partially removed from liquid hydrocarbon streams using methods and equipment that are not desalters, but which could be used as an adjunct to a desalter. It would be further desirable to develop a composition and method employing it that would cause most or all of the mercury in crude oil to be removed from the crude oil prior to the desalter.

SUMMARY

There is provided, in one non-limiting form, a method of removing at least one metal from a homogeneous blend comprising a liquid hydrocarbon and water, the method involving adding at least one demulsifier to the homogeneous blend; extracting at least a portion of the water from the homogeneous blend to leave a treated homogeneous blend; and passing the treated homogeneous blend through at least a first particle filter of a first pore size to give an at least partially demetallized homogeneous blend.

There is alternatively provided a method of removing at least one metal from a liquid hydrocarbon, where the method involves blending water with the liquid hydrocarbon to form a homogenous blend and adding at least one demulsifier to a liquid that is the water blended with the liquid hydrocarbon, the liquid hydrocarbon, the homogeneous blend, or mixtures thereof. The at least one demulsifier includes, but is not necessarily limited to, dodecyl benzene sulfonic acid (DDBSA), alkyl benzene sulfonic acid, toluene sulfonic acid, di-octyl sulfosuccinate, sulfate ethoxylated sulfate ether, disulfonated alkyl diphenyl, sodium benzene sulfonic acid, sodium alkyl benzene sulfonated, isopropyl amine alkyl benzene sulfonated, methane sulfonic acid (MSA), isopropyl naphthalene sulfonic acid, sodium silicate, trithiocarbonate, dithiocarbamate, hydropolysulfide carbonothioylbis-disodium salt, sulfonated styrene-maleic anhydride copolymer (SSMA), copolymers of acrylic acid and sulfonated hydrophobic, aromatic monomers, poly(methacrylic acid) (PMA), poly(acrylic acid) (PAA), 2-acrylamido-2-methylpropane sulfonic acid (AMPS), ethyl vinyl acetate polymer, acid catalyzed nonyl phenol resin oxyalkylate, nonionic and/or ionic surfactants, and combinations thereof.

The method further involves extracting water from the homogeneous blend to leave a treated liquid hydrocarbon, and passing the treated liquid hydrocarbon through at least a first particle filter of a first pore size and to give an at least partially demetallized liquid hydrocarbon. The liquid hydrocarbon includes, but is not necessarily limited to, crude oil, shale oil, natural gas condensates, petroleum distillates, or combinations thereof.

DETAILED DESCRIPTION

It has been discovered that adding at least one demulsifier to a liquid hydrocarbon, such as crude oil, containing a multi-valent metal, such as mercury, before, during or after the liquid hydrocarbon is (optionally) blended with water to form a homogeneous blend, extracting the water from the homogeneous blend, and passing the treated hydrocarbon through at least one first particle filter having a first pore size will at least partially remove the multi-valent metal therefrom.

The blending of water with a liquid hydrocarbon stream may be done in a separation vessel, which may be, but does not have to be, a separation drum, but may be any suitable vessel or container that may accomplish the purposes of the method, and may even be a pipe or conduit of sufficient size.

The liquid hydrocarbon treated may include, but is not necessarily limited to, crude oil, shale oil, natural gas condensates, petroleum distillates, and the like and combinations thereof. Although crude oil is typically used as an example in subsequent discussion, it should be realized that the methods and compositions herein are not limited thereto. In most non-limiting embodiments the liquid hydrocarbon will be blended with water and have at least one demulsifier added thereto, as received. That is, in the case where the liquid hydrocarbon is crude oil, the crude oil is treated as received, in the absence of any prior treatment, regardless of the amount of water that is naturally entrained in the hydrocarbon, and whether or not the received crude oil could be understood as an emulsion.

The introduction of water into the liquid hydrocarbon (e.g. crude oil) by itself may be sufficient mixing to give a homogeneous blend, or there may be an additional intentional mixing process. The additional mixing process may include, but is not necessarily limited to, passing the liquid hydrocarbon and the water through a mix valve or through a static mixer, and/or employing agitation or blending using a paddle mixer, a blender or some other means of introducing energy. The resulting homogeneous blend may be an emulsion, but may be simply a hydrocarbon/water mixture and does not have to be an emulsion.

While the water used does not have to be pure or be deionized water (although it may be), it is suitable if it has low solids, that is, it may be free from visible solids. If the homogeneous blend is an emulsion, it may be an oil-in-water (o/w) emulsion, a water-in-oil (w/o) emulsion, or a bicontinuous emulsion. The amount of water blended with the liquid hydrocarbon may be up to about 15 volume %, based on the liquid hydrocarbon; alternatively from about 0.1 volume % independently up to about 15 volume %, and in another non-limiting embodiment from about 1 independently to about 13 volume %. When used in connection with a range, the term "independently" means that any lower threshold may be combined with any upper threshold to give a suitable and acceptable alternative range.

The method herein may be practiced without or in the absence of a desalter, countercurrent extraction, and/or an intentionally created emulsion. Stated another way, the separation vessel is not a desalter in the conventional sense, although metal salts may be removed by the particle filter(s). However, alternatively the crude oil may contain a naturally occurring emulsion when it is introduced to the separation vessel. As mentioned, it is expected that in many alternative embodiments, this method may be practiced upstream of a desalter, and that the crude oil having reduced multi-valent metal concentration is sent to the desalter. However, this metals removal method may be performed at the oil production site, or any location between the production site and the refining operations or within the refining operations.

At least one demulsifier is added to the homogeneous blend of the water and the liquid hydrocarbon. The at least one demulsifier may include, but is not necessarily limited to, dodecyl benzene sulfonic acid (DDBSA), alkyl benzene sulfonic acid (when the alkyl is linear, this may be abbreviated as LABSA), disulfonated alkyl diphenyl, sodium benzene sulfonic acid, sodium alkyl benzene sulfonated, isopropyl amine alkyl benzene sulfonated, methane sulfonic acid (MSA), isopropyl naphthalene sulfonic acid, sodium silicate, trithiocarbonate, dithiocarbamate, hydropolysulfide carbonothioylbis-disodium salt, sulfonated styrene-maleic anhydride copolymer (SSMA), copolymers of acrylic acid and sulfonated hydrophobic, aromatic monomers, poly (methacrylic acid) (PMA), poly(acrylic acid) (PAA), 2-acrylamido-2-methylpropane sulfonic acid (AMPS), ethyl vinyl acetate polymer, acid catalyzed nonyl phenol resin oxyalkylate, nonionic and/or ionic surfactants, and combinations thereof. One non-limiting suitable source of SSMA is VERSA-TL 3 available from Akzo Nobel; a similar product is available from Sartomer Chemical. One non-limiting suitable source of a copolymer of acrylic acid and sulfonated hydrophobic, aromatic monomers is AQUATREAT® AR 540 antiscalant available from Akzo Nobel. One non-limiting source of PMA is OPTIDOSE™ 4210 PMA available from Rohm and Haas or Dow Chemical. One non-limiting source of PAA is ACCUMER™ 1000 available from Rohm and Haas, now owned by Dow Chemical. Sodium silicate and the nonionic and/or ionic surfactants are water soluble and are advantageously handled and delivered as demulsifiers using water as a solvent. The amount of the at least one demulsifier added may range from about 1 ppm-v independently to about 5000 ppm-v, based on homogeneous blend; alternatively from about 5 ppm-v independently to about 500 ppm-v. Combinations of the demulsifiers are also expected to be useful.

Subsequent to adding at least one demulsifier, the water is extracted from the homogeneous blend using any suitable extraction technique to give a treated hydrocarbon liquid. Suitable extraction techniques include, but are not necessarily limited to, counter-current extraction, electrostatic precipitation, sheer blending and gravimetric phase separation, centrifuging and combinations thereof.

The treated liquid hydrocarbon is then passed through at least one particle filter. The pore size of the filter may range from about 0.1 independently to about 50 microns absolute or nominal, alternatively from about 0.1 independently to about 20 microns. The particle filter may be a filter vessel with filter media. The filter media may be comprised of particulate filters that range in pore size of 50 microns to 0.1 microns and be composed of cellulose fibers, paper, plastic, ceramic, metal or any other suitable material that will separate the metal contaminant out of the hydrocarbon based upon molecular or complex physical sizes. The filters may or may not be staged, and the process may flow from the higher micron size filter to the lower micron filter sizes; that is, the pore sizes will become sequentially smaller. The flow through these filters will render a fluid that is lower in the metal content than the initial feed that was sent to the filter operation. Furthermore, the effluent water from the water and oil phase separation may also undergo its own filtration to reduce the metal content in the waste water stream.

The filter system may be comprised of vessels or conduits that are able to accommodate the filter cartridges, bags, or alternate media. Each vessel or conduit will be able to hold at least one filter cartridge, bag or media unit. In one non-limiting embodiment the filter vessels or conduits may be operated in series of two or more, beginning from a starting point of pore sizes of 0.1 independently to 50 microns, alternatively from about 0.1 to about 20 microns, with subsequent lower pore size micron filters following in each stage of filtration. The particle filter, or series of particle filters, removes at least some of the metal from the treated liquid hydrocarbon to give an at least partially demetallized liquid hydrocarbon.

Without wishing to be limited to any single explanation of the method herein, there may be some degree of reaction of the metal (e.g. mercury) with the at least one demulsifier, although it is expected that the extent of this reaction is limited, if any. In one non-limiting embodiment, no reaction occurs. A chemical reaction of the metal with the at least one demulsifier is not relied upon for the method to be successful. An important aspect of this method is that the metal (e.g. Hg) molecule is allowed to "grow into" or "become" a larger metal (e.g. mercury) molecule or complex that may be captured by the particle filter. In the non-limiting case of mercury, this may be done by the formation of a sulfonated mercury molecule as well as allowing the mercury to agglomerate with other mercury molecules by allowing the surfaces of the mercury atoms and/or molecules to become water wetted and thus grow to a physical size that allows for capture through the filter media, in one non-limiting explanation. In yet another case the metal ions were molecularly encapsulated to form a larger complex which was then able to be filtered.

The multi-valent metals include, but are not necessarily limited to, transition metals such as mercury, iron, copper, zinc, aluminum, lead, and the like and combinations thereof. In one non-limiting embodiment, in the case of iron, the removal of particulate iron is in the form of iron oxide, iron sulfide, etc. and is a specific, non-limiting embodiment of the method described herein.

By "removing" a multi-valent metal from the hydrocarbon or crude is meant any and all partitioning, sequestering, separating, transferring, eliminating, dividing, removing, dropping out of the multi-valent metal from the hydrocarbon or crude oil to any extent. While it is certainly acceptable for all of the metal, such as mercury, to be removed, the method is still considered successful if the level of metal is simply reduced. In one non-limiting embodiment, one goal of the process is to reduce the multi-valent metal content in the crude oil to an acceptable level to be processed in a refinery.

The nonionic surfactants and/or ionic surfactants may be used alone or may be used together with one or more of other multi-valent metal removal chemicals that function as a wetting agent. Such wetting agents, which may be also called conditioners, will help the surfactant contact the metal ion species and interact with them so that the resulting material may be a reaction product or a complex or other associated species that grows or is enlarged in size so that it may be removed. Wetting agents such as nonionic and/or ionic surfactants may also help remove iron sulfide and/or iron oxide alone or in conjunction with another iron removal chemical. Suitable nonionic and/or ionic surfactants include, but are not necessarily limited to, alkyl benzene sulfonic acids, amine neutralized alkyl benzene sulfonic acids, toluene sulfonic acid, di-octyl sulfosuccinate, sulfate ethoxylated sulfate ether and mixtures thereof.

In another non-limiting embodiment, additional water may be added after adding the at least one demulsifier, but before and/or after extracting water to give a treated liquid hydrocarbon. Such second or subsequent adding of water (there may be more than two water adding steps) is optional, but may be helpful. Such second or subsequent step, if considered necessary, may blend the liquid hydrocarbon (in a non-limiting instance, the already treated liquid hydrocarbon) with from about 0.5 independently to about 10 volume % of wash water. Again, this blend may be allowed to pass through a mix valve, static mixer and/or some form of applied energy including, but not limited to, an agitation or blending mechanism to ensure a homogeneous blend. In another non-limiting embodiment, the amount of water added in the first, second or subsequent steps may range from about 3 independently to about 7 volume %, based on the liquid hydrocarbon.

Optionally, the liquid hydrocarbon stream, homogeneous blend, treated liquid hydrocarbon, and/or separation vessel may be heated, such as to a temperature between about 35° F. (about 1.7° C.) independently to about 400° F. (about 204° C.); alternatively to a temperature between about 120° F. (about 49° C.) independently to about 320° F. (160° C.). Whether heating is applied is driven by factors including, but not necessarily limited to, phase separation efficiency, vapor pressure constraints and viscosity. The liquid hydrocarbon stream, homogeneous blend, treated liquid hydrocarbon, and/or separation vessel may also be subjected to an electrostatic field, again depending on such factors including, but not necessarily limited to, phase separation efficiency. However, as noted, the present method does not require an electrostatic field and should not be considered as practiced in a "desalter" although some removal of metal salts may consequently occur. The method and apparatus discussed may, however, optionally be used as an adjunct to conventional desalter operations, if deemed necessary.

The invention will be illustrated further with reference to the following Examples, which are not intended to limit the invention, but instead illuminate it further.

EXAMPLES 1-10

Examples 1-10 presented in Table I demonstrate the removal of mercury from raw crude oil treated with the indicated levels of Chemical 1 or Chemical 2, with or without filtration, and with or without washing with water, as noted. Chemical 1 (Chem 1) was a complex blend of ethyl vinyl acetate polymer and acid catalyzed nonyl phenol resin oxyalkylate. Chemical 2 (Chem 2) was DDBSA. It may be seen that the results of Examples 5-10 that employed both a demulsifier and filtration gave the best results, on the order of parts per billion (ppb) rather than in terms of parts per million (ppm), indicating greater removal.

TABLE I

Examples 1-10 - Mercury Removal

| Ex. | Test Parameters | Mercury Content |
|---|---|---|
| 1 | Raw Crude, Untreated | 7.9 ppm |
| 2 | Raw Crude, treated with 2000 ppm of Chemical 1 | 6.6 ppm |

TABLE I-continued

Examples 1-10 - Mercury Removal

| Ex. | Test Parameters | Mercury Content |
|---|---|---|
| 3 | Raw Crude, treated with 2000 ppm of Chemical 2 | 6.3 ppm |
| 4 | Raw Crude, filtration only | 5.9 ppm |
| 5 | Crude, treated with 2000 ppm Chem 2, water washed with Production water, and filtered through 5 micron filter | 2950 ppb |
| 6 | Crude, treated with 2000 ppm Chem 2, water washed with distilled water, and filtered through 5 micron filter | 2350 ppb |
| 7 | Crude. Treated with 2000 ppm Chem 2, water washed with production water, and filtered through 1 micron filter | 1460 ppb |
| 8 | Crude, treated with 2000 ppm Chem 2, water washed with distilled water and filtered through 1 micron filter | 1160 ppb |
| 9 | Crude treated with 50 ppm of Chem 2, water washed with production water, and filtered through 0.45 micron filter | 957 ppb |
| 10 | Crude treated with 50 ppm of Chem 2, water washed with production water, and filtered through 0.1 micron filter | 707 ppb |

In the foregoing specification, the invention has been described with reference to specific embodiments thereof, such as removing or reducing the presence of multi-valent metal in liquid hydrocarbon streams including, but not limited to, crude oil. However, it will be evident that various modifications and changes can be made thereto without departing from the broader scope of the invention as set forth in the appended claims. Accordingly, the specification is to be regarded in an illustrative rather than a restrictive sense. For example, specific multi-valent metals, demulsifiers, wetting agents, extraction methods, particle filters, heating ranges, water proportions, demulsifier proportions, and combinations thereof, other than those specifically exemplified or mentioned, or in different proportions, falling within the claimed parameters, but not specifically identified or tried in a particular application to remove multi-valent metal species, are within the scope of this invention. Similarly, it is expected that the inventive compositions and/or methods will find utility in removing other metals methods besides those mentioned, and for other fluids besides crude oil.

The terms "comprises" and "comprising" in the claims should be interpreted to mean including, but not limited to, the recited elements. The present invention may suitably comprise, consist or consist essentially of the elements disclosed and may be practiced in the absence of an element not disclosed.

For instance, a method of removing at least one metal from a liquid hydrocarbon comprising water, where the method may consist essentially of or consist of adding at least one demulsifier to the liquid hydrocarbon; extracting water from the homogeneous blend to leave a treated liquid hydrocarbon; and passing the treated liquid hydrocarbon sequentially through at least a first particle filter of a first pore size to give an at least partially demetallized liquid hydrocarbon.

In an alternative case, a method of removing at least one metal from a liquid hydrocarbon may consist essentially of or consist of blending water with the liquid hydrocarbon to form a homogeneous blend; adding at least one demulsifier to a liquid selected from the group consisting of the water, the liquid hydrocarbon, the homogeneous blend and mixtures thereof; extracting the water from the homogeneous blend to leave a treated liquid hydrocarbon; and passing the treated liquid hydrocarbon sequentially through at least a first particle filter of a first pore size and a subsequent particle filters of various pore size, where the subsequent pore size is smaller than the preceding pore size, to give an at least partially demetallized liquid hydrocarbon.

What is claimed is:

1. A method of removing at least one metal from a homogenous blend comprising a liquid hydrocarbon, water and the at least one metal, the method comprising:

adding at least one demulsifier to the homogenous blend;

extracting at least a portion of the water from the homogeneous blend to leave a treated homogenous blend; and passing the treated homogenous blend through at least a first particle filter of a first pore size to give an at least partially demetallized homogenous blend;

in the absence of a desalter.

2. The method of claim 1 where the homogenous blend is selected from the group consisting of crude oil, shale oil, natural gas condensates, petroleum distillates, and combinations thereof.

3. The method of claim 2 where the homogeneous blend is a first homogeneous blend, and where the method further comprises after adding the demulsifier there is a second blending of water, where the amount of water in the second blending ranges from about 0.5 to about 10 volume %, based on the homogeneous blend to give a second homogeneous blend.

4. The method of claim 1 where the homogeneous blend is a first homogeneous blend and where the method further comprises, prior to adding the at least one demulsifier to the first homogenous blend, blending water with the liquid hydrocarbon to form a second homogeneous blend.

5. The method of claim 4 where the amount of water blended with the liquid hydrocarbon ranges up to about 15 volume %.

6. The method of claim 4 where the blending occurs in a separation vessel.

7. The method of claim 6 where the separation vessel is heated to a temperature between about 35° F. to about 400° F. (about 1.7 to about 204° C.).

8. The method of claim 4 where in blending the water, the water does not have visible solids.

9. The method of claim 1 where the at least one demulsifier is selected from the group consisting of dodecyl benzene sulfonic acid (DDBSA), alkyl benzene sulfonic acid, toluene sulfonic acid, di-octyl sulfosuccinate, sulfate ethoxylated sulfate ether, disulfonated alkyl diphenyl, sodium benzene sulfonic acid, sodium alkyl benzene sulfonated, isopropyl amine alkyl benzene sulfonated, methane sulfonic acid (MSA), isopropyl naphthalene sulfonic acid, sodium silicate, trithiocarbonate, dithiocarbamate, hydropolysulfide carbonothioylbis-disodium salt, sulfonated styrene-maleic anhydride copolymer (SSMA), copolymers of acrylic acid and sulfonated hydrophobic, aromatic monomers, poly(methacrylic acid) (PMA), poly(acrylic acid) (PAA), 2-acrylamido-2-methylpropane sulfonic acid (AMPS), ethyl vinyl acetate polymer, acid catalyzed nonyl phenol resin oxyalkylate, nonionic and/or ionic surfactants, and combinations thereof.

10. The method of claim 1 where the amount of the at least one demulsifier added ranges from about 1 ppm-v to about 5000 ppm-v, based on the liquid hydrocarbon.

11. The method of claim 1 further comprising, subsequent to passing the treated homogenous blend sequentially through at least a first particle filter of a first pore size, passing the treated homogenous blend through at least one subsequent filter, where the at least one subsequent filter pore size is smaller than the preceding pore size.

12. The method of claim 11 where the pore sizes in the first and subsequent particle filters range from about 0.1 microns to about 50 microns.

13. The method of claim 1 further comprising subjecting the homogeneous blend to an electrostatic field.

14. The method of claim 1 where the at least one metal is selected from the group consisting of mercury, iron, copper, aluminum, and combinations thereof.

15. A method of removing at least one metal from a liquid hydrocarbon, the method comprising:

blending water with the liquid hydrocarbon to form a homogenous blend;

adding at least one demulsifier to a liquid selected from the group consisting of the water blended with the liquid hydrocarbon, the liquid hydrocarbon, the homogeneous blend, and mixtures thereof, where the at least one demulsifier is selected from the group consisting of dodecyl benzene sulfonic acid (DDBSA), alkyl benzene sulfonic acid, toluene sulfonic acid, di-octyl sulfosuccinate, sulfate ethoxylated sulfate ether, disulfonated alkyl diphenyl, sodium benzene sulfonic acid, sodium alkyl benzene sulfonated, isopropyl amine alkyl benzene sulfonated, methane sulfonic acid (MSA), isopropyl naphthalene sulfonic acid, sodium silicate, trithiocarbonate, dithiocarbamate, hydropolysulfide carbonothioylbis-disodium salt, sulfonated styrene-maleic anhydride copolymer (SSMA), copolymers of acrylic acid and sulfonated hydrophobic, aromatic monomers, poly(methacrylic acid) (PMA), poly(acrylic acid) (PAA), 2-acrylamido-2-methylpropane sulfonic acid (AMPS), ethyl vinyl acetate polymer, acid catalyzed nonyl phenol resin oxyalkylate, nonionic and/or ionic surfactants, and combinations thereof;

extracting water from the homogeneous blend to leave a treated liquid hydrocarbon; and passing the treated homogenous blend through at least a first particle filter of a first pore size to give an at least partially demetallized liquid hydrocarbon;

where the liquid hydrocarbon is selected from the group consisting of crude oil, shale oil, natural gas condensates, petroleum distillates, and combinations thereof; and where the method is practiced in the absence of a desalter.

16. The method of claim 15 where the amount of water blended with the liquid hydrocarbon ranges from about 0.1 to about 15 volume %, based on the liquid hydrocarbon.

17. The method of claim 15 where the amount of the at least one demulsifier added ranges from about 1 ppm-v to about 5000 ppm-v, based on the liquid hydrocarbon.

18. The method of claim 15 where the homogeneous blend is a first homogeneous blend, and where the method further comprises after adding the demulsifier there is a second blending of water, where the amount of water in the second blending ranges from about 0.5 to about 10 volume %, based on the homogeneous blend to give a second homogeneous blend.

19. The method of claim 15 where the at least one metal is selected from the group consisting of mercury, iron, copper, aluminum, and combinations thereof.

20. A method of removing at least one metal from a liquid hydrocarbon, the method comprising:

blending from about 0.1 to about 15 volume %, based on the liquid hydrocarbon, water with the liquid hydrocarbon to form a homogenous blend;

adding from about 1 ppm-v to about 5000 ppm-v, based on the liquid hydrocarbon, of at least one demulsifier to a liquid selected from the group consisting of the water blended with the liquid hydrocarbon, the liquid hydrocarbon, the homogeneous blend, and mixtures thereof, where the at least one demulsifier is selected from the group consisting of dodecyl benzene sulfonic acid (DDBSA), alkyl benzene sulfonic acid, toluene sulfonic acid, di-octyl sulfosuccinate, sulfate ethoxylated sulfate ether, disulfonated alkyl diphenyl, sodium benzene sulfonic acid, sodium alkyl benzene sulfonated, isopropyl amine alkyl benzene sulfonated, methane sulfonic acid (MSA), isopropyl naphthalene sulfonic acid, sodium silicate, trithiocarbonate, dithiocarbamate, hydropolysulfide carbonothioylbis-disodium salt, sulfonated styrene-maleic anhydride copolymer (SSMA), copolymers of acrylic acid and sulfonated hydrophobic, aromatic monomers, poly(methacrylic acid) (PMA), poly(acrylic acid) (PAA), 2-acrylamido-2-methylpropane sulfonic acid (AMPS), ethyl vinyl acetate polymer, acid catalyzed nonyl phenol resin oxyalkylate, nonionic and/or ionic surfactants, and combinations thereof;

extracting water from the homogeneous blend to leave a treated liquid hydrocarbon; and passing the treated homogenous blend through at least a first particle filter of a first pore size to give an at least partially demetallized liquid hydrocarbon;

where the liquid hydrocarbon is selected from the group consisting of crude oil, shale oil, natural gas condensates, petroleum distillates, and combinations thereof; and where the method is practiced in the absence of a desalter.

* * * * *